US008425188B2

(12) United States Patent
Dovbush et al.

(10) Patent No.: US 8,425,188 B2
(45) Date of Patent: Apr. 23, 2013

(54) DIFFUSER PIPE AND ASSEMBLY FOR GAS TURBINE ENGINE

(75) Inventors: Andrey Petrovich Dovbush, Vsevolozsk (RU); Valery Ivanovich Kislov, Saint-Petersburg (RU)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 0 days.

(21) Appl. No.: 13/490,860

(22) Filed: Jun. 7, 2012

(65) Prior Publication Data

US 2013/0000308 A1 Jan. 3, 2013

Related U.S. Application Data

(63) Continuation of application No. PCT/RU2011/000473, filed on Jun. 30, 2011.

(51) Int. Cl.
*F03B 1/00* (2006.01)

(52) U.S. Cl.
USPC ..... 415/208.3; 415/208.2; 415/211.2

(58) Field of Classification Search ..... 415/208.2, 415/208.3, 209.2, 211.2, 214.1
See application file for complete search history.

(56) References Cited

U.S. PATENT DOCUMENTS

| | | | |
|---|---|---|---|
| 2,735,612 | A | 2/1956 | Hausmann |
| 3,144,202 | A | 8/1964 | Helmbold |
| 3,289,921 | A | 12/1966 | Soo |
| 3,578,264 | A | 5/1971 | Kuethe |
| 3,644,055 | A | 2/1972 | Davis |
| 4,098,073 | A | 7/1978 | Adkins et al. |
| 4,100,732 | A | 7/1978 | Bryans et al. |
| 4,272,955 | A | 6/1981 | Hoffman et al. |
| 4,431,374 | A | 2/1984 | Benstein et al. |
| 4,497,445 | A | 2/1985 | Adkins et al. |
| 4,696,622 | A | 9/1987 | Traczyk et al. |
| 4,796,429 | A | 1/1989 | Verdouw |
| 4,979,361 | A | 12/1990 | Clark et al. |
| 5,387,081 | A | 2/1995 | LeBlanc |
| 5,564,898 | A | 10/1996 | Richards et al. |
| 6,471,475 | B1 | 10/2002 | Sasu et al. |
| 6,540,481 | B2 | 4/2003 | Moussa et al. |
| 6,589,015 | B1 | 7/2003 | Roberts et al. |
| 6,647,730 | B2 | 11/2003 | Liu |
| 7,101,151 | B2 | 9/2006 | Loringer et al. |
| 7,156,618 | B2 | 1/2007 | Fish et al. |
| 2006/0104809 | A1 | 5/2006 | Fish et al. |
| 2010/0278643 | A1 | 11/2010 | Leblanc et al. |

FOREIGN PATENT DOCUMENTS

| | | | |
|---|---|---|---|
| RU | 2103560 | C1 | 1/1998 |
| SU | 311050 | A1 | 10/1971 |
| SU | 1308781 | A1 | 5/1987 |

OTHER PUBLICATIONS

European Search Report for EP Patent Application No. 12173659.9, dated Oct. 12, 2012.

International Search Report mailed on Mar. 23, 2012, on Applicant's corresponding priority PCT International Patent Application No. PCT/RU2011/00473.

*Primary Examiner* — Nathaniel Wiehe
*Assistant Examiner* — Justin Seabe
(74) *Attorney, Agent, or Firm* — Bachman & LaPointe, P.C.

(57) ABSTRACT

A diffuser pipe (38) of a compressor diffuser assembly (28) for gas turbine engines defines a depressed local area (58) in the pipe wall of an upstream section of the diffuser pipe (38). The depressed local area (58) is bent into the diffuser pipe (38) to reduce the accumulation of fluid boundary layer and improve stall margin of the diffuser pipe (38).

17 Claims, 3 Drawing Sheets

DIFFUSER PIPE AND ASSEMBLY FOR GAS TURBINE ENGINE

CROSS-REFERENCE TO RELATED APPLICATION

This is a continuation application of PCT/RU2011/000473, filed Jun. 30, 2011, and entitled Diffuser Pipe and Assembly for Gas Turbine Engine.

TECHNICAL FIELD

The described subject matter relates generally to gas turbine engines, and more particularly, to an improved compressor diffuser assembly for gas turbine engines.

BACKGROUND OF THE ART

Typically, gas turbine engines include a compressor section which delivers pressurized air to a continuous flow combustor. A diffuser assembly is usually provided in the compressor section of the engine for the purpose of converting the dynamic head of the pressurized air generated by the compressor into static pressure. For example, diffuser assemblies of some types may employ diffuser pipes each having a cross-section expanding rearwardly towards an exit end of the pipe, to direct the pressurized air therethrough and discharge the pressurized air to the combustion section of the engine at a low velocity and high static pressure. Ideally, it is desirable to convert the dynamic head of the pressurized air generated by the compressor into static pressure at the combustion section without any loss of total pressure. However, the efficiency or effectiveness of diffuser assemblies known in the art is less than satisfactory.

Accordingly, there is a need to provide an improved compressor diffuser assembly for gas turbine engines.

SUMMARY

In one aspect, the described subject matter provides a diffuser pipe assembly (28) of a gas turbine engine including a plurality of circumferentially spaced diffuser pipes (38), each diffuser pipe (38) comprising a substantially truncated conical inlet end section (46) defining an inlet end (40) of the diffuser pipe (38) and a curved section (48) defining an exit end (41) of the diffuser pipe (38) to direct a pressurized airflow from the inlet end (40) through the diffuser pipe (38) to the exit end (41), the curved section (48) having a cross-section expanding rearwardly towards the exit end (41) such that the curved section (48) presents a curved fishtail profile, the inlet end section (46) defining a depressed local area (58) in a pipe wall of the inlet end section (46) such that both inner and outer surfaces of the pipe wall in the depressed local area (58) are bent into the diffuser pipe (38), wherein each consecutive cross section area Sn+1 is bigger than or equal to a preceding one Sn.

In another aspect, the described subject matter provides a diffuser assembly (28) for a gas turbine engine comprising an annular diffuser body (32) having a plurality of orifices (34) disposed circumferentially around an outer periphery (36) of the diffuser body (32); a plurality of diffuser pipes (38) each having an inlet end (40) connected to one of the orifices (34) of the diffuser body (32), each of the diffuser pipes (38) including an inlet end section (46) in a substantially round cross section defining the inlet end (40) and a curved section (48) defining an exit end (41) of the diffuser pipe (38) to direct a pressurized airflow from the inlet end (40) through a passage to the exit end (41), the curved section (48) having a cross-section expanding rearwardly towards the exit end (41) such that the curved section (48) presents a curved fishtail profile; and wherein at least one of the diffuser pipes (38) defines a depressed local area (58) in a pipe wall of an upstream section of the at least one diffuser pipe (38) such that both inner and outer surfaces of the pipe wall in the depressed local area (58) are bent into the at least one diffuser pipe (38), wherein each consecutive cross section area Sn+1 is bigger than or equal to the preceding one Sn.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
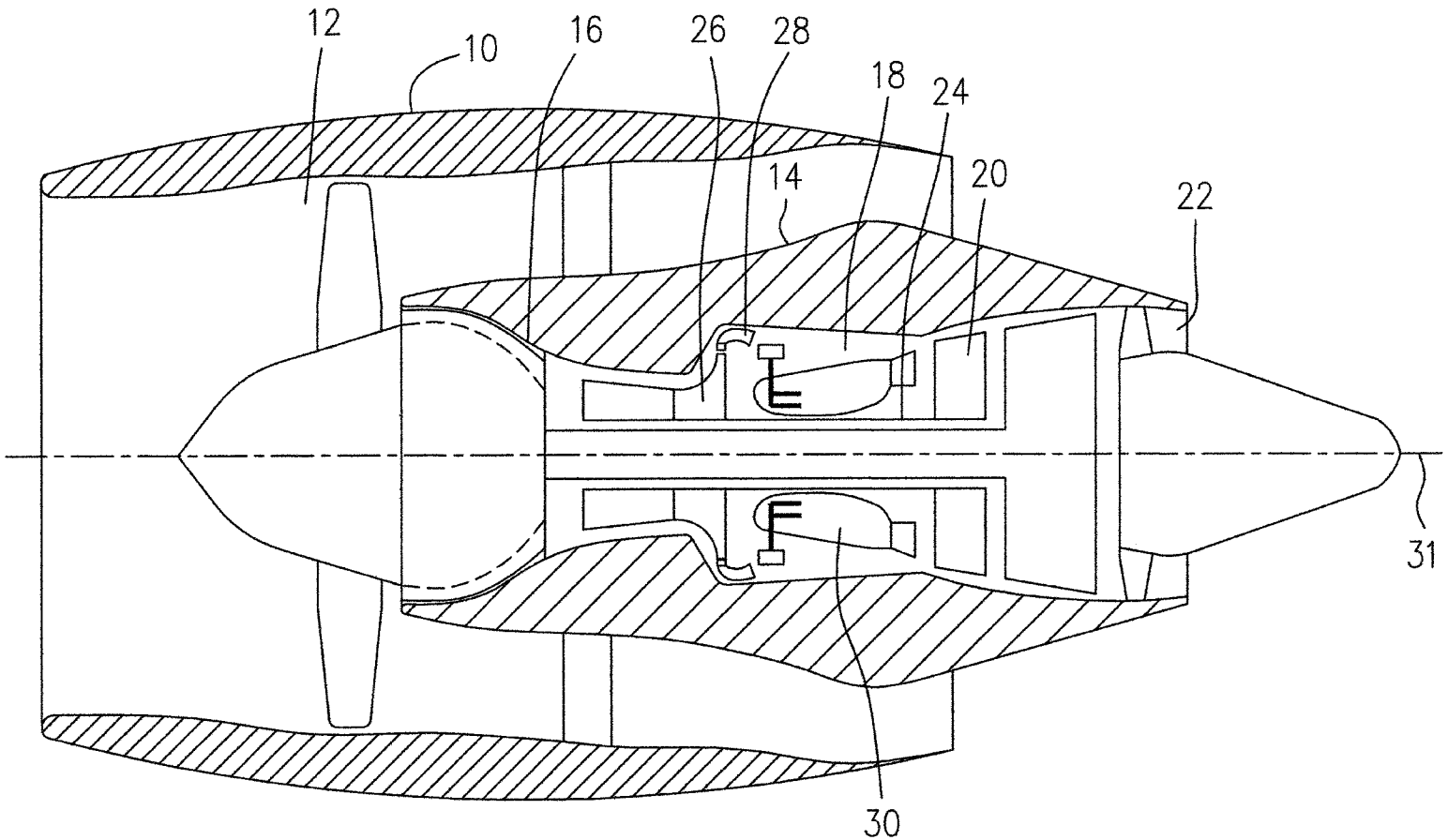
FIG. 1 is a schematic cross-sectional view of a turbofan gas turbine engine showing an exemplary application of the described subject matter.

Referring to FIG. 1, a turbofan gas turbine engine incorporates an embodiment of the described subject matter, presented as an example of the application of the described subject matter, and includes a housing or a nacelle 10 which contains a fan section 12 and at least a major section of a core engine 14. The core engine 14 comprises in flow series, a compressor section 16, a combustion section 18, a turbine section 20, and an exhaust section 22. The turbine section 20 and the compressor section 16 comprise multiple stages. At least one turbine (not indicated) within the turbine section 20 is rotationally connected to a final stage of the compressor section 16 by a shaft 24.

The final stage of the compressor section 16 is a rotating impeller 26 in flow communication with combustion section 18 through a diffuser assembly 28. The impeller 26 draws air axially, and rotation of the impeller 26 about a central axis 31 of the engine increases the velocity of air flow as input air is directed over impeller vanes (not numbered), to flow in a radially outward direction under centrifugal forces. The diffuser assembly 28 redirects the radial flow of air exiting the impeller 26 to an annular axial flow for presentation to a combustor 30. The diffuser assembly 28 also reduces the velocity and increases the static pressure of the air flow when the air flow is directed therethrough.

Figure 2:
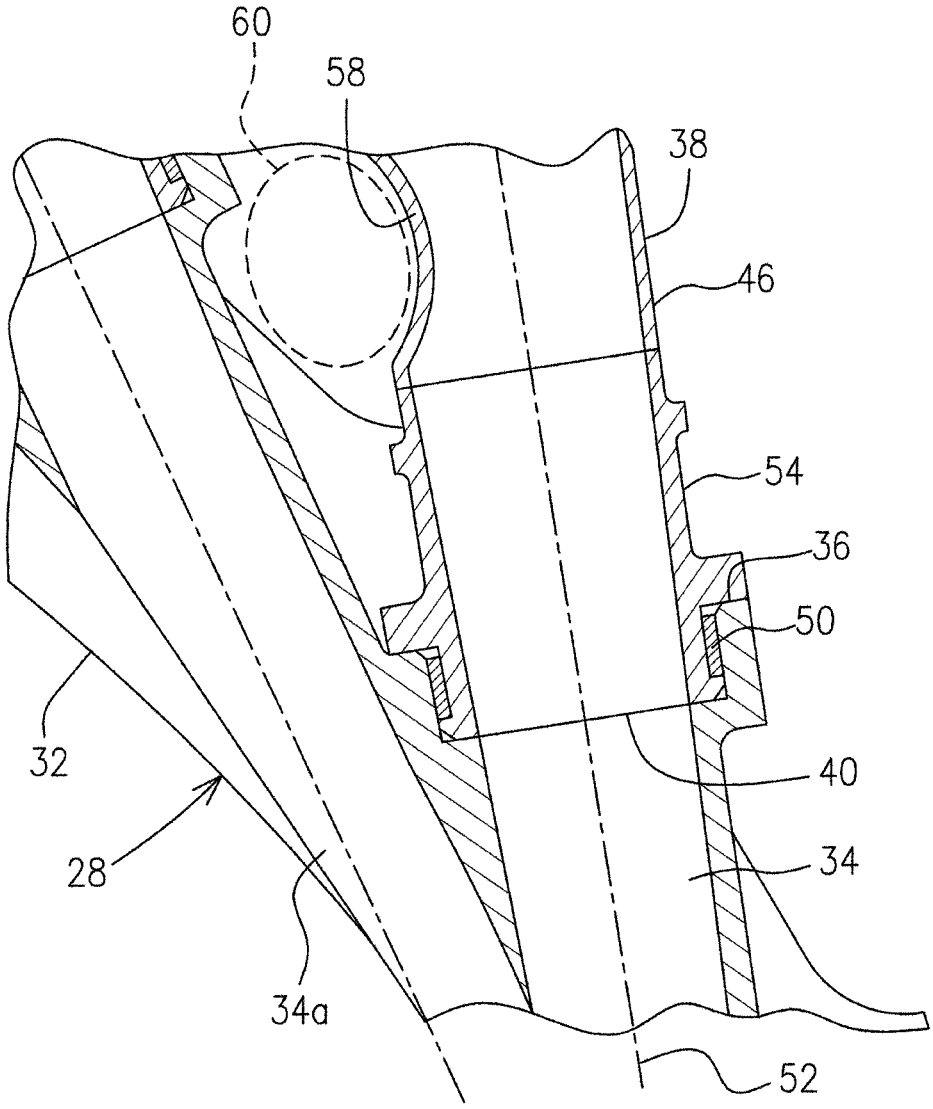
FIG. 2 is a partial cross-sectional view of a compressor diffuser assembly used in the engine of FIG. 1.

Referring to FIGS. 1-5, the compressor diffuser assembly 28 includes an annular diffuser body 32 which is a machined ring having a plurality of substantially tangential orifices 34 disposed circumferentially spaced apart in an outer periphery 36 of the diffuser body 32, and extending inwardly and substantially tangentially through the annular diffuser body 32. Each of the orifices 34 is intersected by two adjacent orifices in an asymmetrical configuration (one adjacent orifice indicated as 34*a* is shown in FIG. 2). With such a configuration, the annular diffuser body 32 is positioned to surround a periphery of the impeller 26 for capturing the pressurized air flow and directing same radially and outwardly through the substantially tangential orifices 34.

The compressor diffuser assembly 28 further includes a plurality of diffuser pipes 38 (only one shown in FIG. 2) connected to the respective orifices 34 of the annular diffuser body 32, for example, by being inserted at an inlet end 40 of the diffuser pipe 38 into the individual orifices 34 of the annular diffuser body 32. Each of the diffuser pipes 38 has a cross-section expanding rearwardly towards an exit end 41 thereof, which is generally referred to as "fishtail" pipes. The diffuser pipes 38 define respective circumferentially spaced passages (not numbered) to further direct the pressurized air flow from the individual substantially tangential orifices 34 through the rearwardly expanding cross-section, thereby discharging the pressurized air flow to the combustion section 18 at a low velocity and high static pressure.

All orifices 34 and diffuser pipes 38 are substantially identical, respectively, and therefore only one orifice and one diffuser pipe are described in detail for convenience of description. However, a depressed local area in a pipe wall may be provided to one or more, up to all diffuser pipes 38 of the diffuser assembly 28, which will be further described hereinafter.

Figure 4:
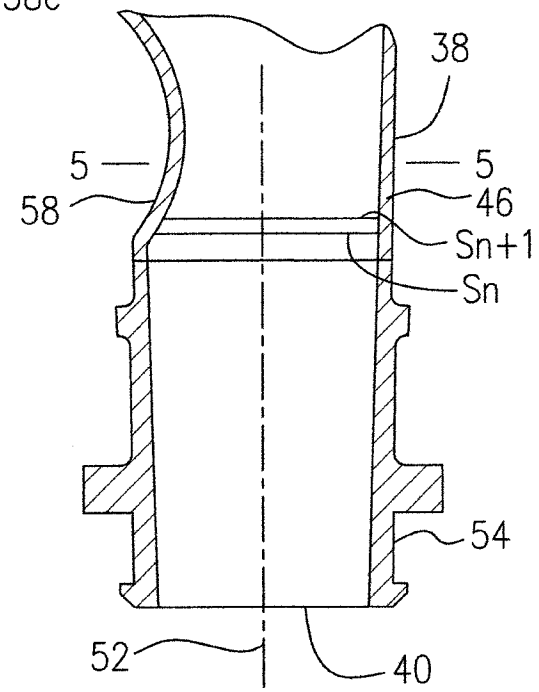
FIG. 4 is an enlarged cross-sectional view of an end portion of the diffuser pipe, as shown in the circled area 4 in FIG. 3.

The diffuser pipe 38 includes an inlet end section 46 defining the inlet end 40 and having a substantially truncated conical profile such that the inlet end section 46 has a round cross-section slightly rearwardly expanding, as is more clearly shown in FIG. 4.

The remaining section of the diffuser pipe 38, referred to as a section 48, has a curved profile for directing the air flow passing therethrough, from a radial direction (or a substantially tangential direction of the annular diffuser body 32) to a substantially axial direction of the engine. The curved section 48 of the diffuser pipe 38 has a cross-section expanding rearwardly towards the exit end 41 thereof, such that the section 48 of the diffuser pipe 38 represents a curved fishtail profile with the exit end 41 in a non-round shape, as more clearly shown in FIG. 3. Therefore, the diffuser pipe 38 defines a central axis 52 extending through the inlet end section 46 in a substantially tangential direction with respect to the annular diffuser body 32 (or in a substantially radial direction with respect to the central axis 31), and then curving through the section 48 so as to extend at the exit end 41 in a substantial axial direction with respect to the engine axis 31.

The inlet end section 46 may also include a connector 54 of the diffuser pipe 38 which may be a machined part for the connection of the diffuser pipe 38 with an entry portion of a corresponding orifice 34 of the annular diffuser body 32. A damper member 50 may be provided between the connector 54 and the entry portion of the orifice 34 to provide a snug attachment of the diffuser pipe 38 to the orifice 34 of the annular diffuser body 32. The machined connector 54 is affixed to a remaining section of the inlet end section 46 which is substantially cylindrical at the location of the affix. The remaining section of the inlet end section 46 may be integrated and formed together in a fabrication process, with the curved section 48 which has a cross-section rearwardly expanding. An imaginary line 56 shown in FIG. 3 indicates a boundary between the substantially truncated conical inlet end section 46 and the curved section 48.

As described, the diffuser pipe 38 directs the pressurized air flow generated by the impeller 26 and captured by the annular diffuser body 32, which exhibits an extremely high fluid velocity and considerable dynamic pressure of the fluid contributable to the velocity of the fluid, through the rearwardly expanding passage defined by the pipe, to thereby discharge the pressurized air flow to the combustion section 18 at a low velocity and high static pressure. However, the pressurized air flow flowing through the diffuser pipe 38 tends to accumulate a fluid boundary layer on the inner surface of the pipe wall. The thickness of the boundary layer progressively increases as the diffuser pipe 38 extends in the downstream direction. Accumulation of the fluid boundary layer reduces the effective cross-sectional flow area of the diffuser pipe 38 such that, at the exit end 41, the boundary layer thickness and the reduced effective flow area significantly weaken further conversion of the dynamic pressure into static pressure of the pressurized air flow.

Figure 3:
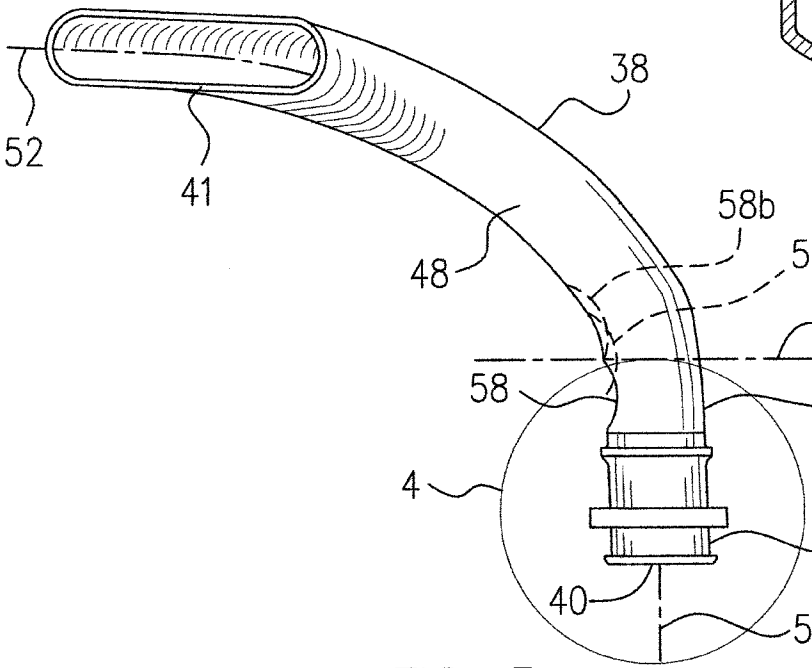
FIG. 3 is a perspective view of a diffuser pipe used in the compressor diffuser assembly of FIG. 2.

In accordance with one embodiment, a depressed local area 58 in the pipe wall, for example of an upstream section of the diffuser pipe 38, is provided such that inner and outer surfaces (not numbered) of the pipe wall in the depressed local area are bent into the diffuser pipe 38. The depressed local area may be formed not to impair the diffusing geometry of the pipe passage such that each consecutive cross section area Sn+1 is bigger than or equal to the preceding one Sn, i.e. ($Sn+1 \geqq Sn$). For example, the depressed local area 58 may be located in the pipe wall of the inlet end section 46 of the diffuser pipe 38, in a location downstream of the connector 54, but immediately upstream of the curved section 48, as shown in FIG. 3. Nevertheless, the depressed local area 58 may be located otherwise, such as in a location spanning the imaginary line 56 or adjacent the imaginary line 56 but in the side of the curved diffusing section as indicated by broken lines 58*a* and 58*b* in FIG. 3. It should be noted that the depressed local area shown in the drawings may be exaggerated for illustration and may not be proportional to the size of the real pipe product.

The depressed local area 58 defines a region of relatively high surface curvature to create a localized acceleration of the pressurized air flow passing through the region where the fluid boundary layer of the air flow can be prone to separation, thereby reducing the accumulation of the fluid boundary layer. Therefore, the depressed local area 58 improves stall margin of the diffuser pipe 38 without significantly compromising overall performance of the diffuser assembly 28, in contrast to conventional annular throat configurations which significantly reduce the flow area of the passage and increases overall flow velocity.

In another aspect, the depressed local area 58 provides additional local space within a relatively crowded neighbouring area of the diffuser pipes 38, which may be desirable in engine manufacturing. For example, the depressed local area 58 according to one embodiment, may be located in the pipe wall of the diffuser pipe 38 directly facing a portion of the annular diffuser body 32 which defines the orifice 34*a* adjacent the orifice 34 connected to the diffuser pipe 38 which has the depressed local area 58, thereby providing an enlarged space as indicated by a circular broken line 60 between the diffuser pipe 38 and the annular diffuser body 32, as shown in FIG. 2. In some types of diffuser assemblies, this enlarged space 60 may be desirable to ease the challenging job of routing service tubes extending between the diffuser body and the diffuser pipes, which facilitates service tube manufacturing and thus reduces costs.

Alternatively, in some types of diffuser assemblies the depressed local area 58 in the pipe wall is in a location directly facing a portion of an adjacent diffuser pipe, thereby providing an enlarged space between the at two adjacent diffuser pipes.

The described depressed local area 58 in the pipe wall may be defined in one or more selected, but up to all of the diffuser pipes 38 connected to the annular diffuser body 32. The depressed local areas in the pipe wall of the respective diffuser pipes 38 may be in a same shape and same location which are not necessary but may be for convenience of diffuser pipe fabrication.

The formation of depressions in local areas of the pipe wall of diffuser pipes may be completed in a pressing process either with existing diffuser pipes without a local depression or in a pipe manufacturing procedure for fabricating new diffuser pipes having depressed local areas.

Figure 5:
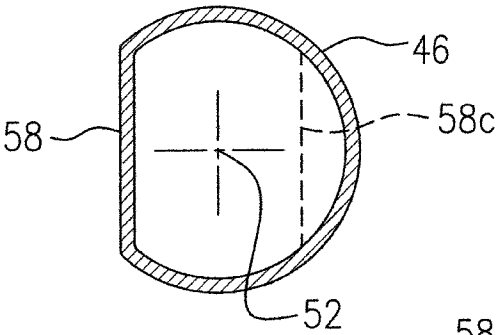
FIG. 5 is a cross-sectional view of the diffuser pipe, taken along line 5-5 of FIG. 4.

Alternatively, diffuser pipe 38 may include more than one depressed local area spaced apart from one another. For example, FIG. 5 shows a second depressed local area indicated by broken line 58*c* located diametrically opposite the depressed local area 58, with respect to the central axis 52 of the diffuser pipe 38.

The above description is meant to be exemplary only, and one skilled in the art will recognize that changes may be made to the embodiments described without departure from the scope of the described subject matter. For example, the diffuser pipes and diffuser assembly described in the embodiments are used in a turbofan gas turbine engine as illustrated in the drawings as an exemplary application, will be applicable to any other suitable types of engines. The diffuser pipes may have a machined connector, or may otherwise be formed of sheet metal without a machined connector. Still other modifications which fall within the scope of the described subject matter will be apparent to those skilled in the art, in light of a review of this disclosure, and such modifications are intended to fall within the appended claims.

The invention claimed is:

1. A diffuser pipe assembly (28) of a gas turbine engine including a plurality of circumferentially spaced diffuser pipes (38), each diffuser pipe (38) comprising a substantially truncated conical inlet end section (46) defining an inlet end (40) of the diffuser pipe (38) and a curved section (48) defining an exit end (41) of the diffuser pipe (38) to direct a pressurized airflow from the inlet end (40) through the diffuser pipe (38) to the exit end (41), the curved section (48) having a cross-section expanding rearwardly towards the exit end (41) such that the curved section (48) presents a curved fishtail profile, the inlet end section (46) defining a depressed local area (58) in a pipe wall of the inlet end section (46) such that both inner and outer surfaces of the pipe wall in the depressed local area (58) are bent into the diffuser pipe (38), wherein each consecutive cross section area Sn+1 is bigger than or equal to a preceding one Sn.

2. The diffuser pipe assembly (28) as defined in claim 1 wherein the depressed local area (58) in the pipe wall of the inlet end section (46) is located immediately upstream of the curved section (48).

3. The diffuser pipe assembly (28) as defined in claim 1 wherein the depressed local area (58*a* or 58*b*) in the pipe wall is located in the curved section (48).

4. The diffuser pipe assembly (28) as defined in claim 1 wherein the inlet end section (46) comprises a connector (54) defining the inlet end (40) and wherein the depressed local area (58) in the pipe wall of the inlet end section (46) is located downstream of the connector (54).

5. The diffuser pipe assembly (28) as defined in claim 1 comprising a second depressed local area (58*c*) in the pipe wall of the inlet end section (46), circumferentially spaced apart from said depressed local area (58) with respect to a central axis (52) of the diffuser pipe (38).

6. The diffuser pipe assembly (28) as defined in claim 5 wherein the second depressed local area (58*c*) is located diametrically opposite to said depressed local area (58) with respect to a central axis (52) of the diffuser pipe (38).

7. A diffuser assembly (28) for a gas turbine engine comprising:

an annular diffuser body (32) having a plurality of orifices (34) disposed circumferentially around an outer periphery (36) of the diffuser body (32);

a plurality of diffuser pipes (38) each having an inlet end (40) connected to one of the orifices (34) of the diffuser body (32), each of the diffuser pipes (38) including an inlet end section (46) in a substantially round cross section defining the inlet end (40) and a curved section (48) defining an exit end (41) of the diffuser pipe (38) to direct a pressurized airflow from the inlet end (40) through a passage to the exit end (41), the curved section (48) having a cross-section expanding rearwardly towards the exit end (41) such that the curved section (48) presents a curved fishtail profile; and wherein at least one of the diffuser pipes (38) defines a depressed local area (58) in a pipe wall of an upstream section of the at least one diffuser pipe (38) such that both inner and outer surfaces of the pipe wall in the depressed local area (58) are bent into the at least one diffuser pipe (38), wherein each consecutive cross section area Sn+1 is bigger than or equal to the preceding one Sn.

8. The diffuser assembly (28) as defined in claim 7 wherein a central axis (52) of each of the diffuser pipes (38) extends through the inlet end section (46) in a substantially tangential direction with respect to the annular diffuser body (32) and extends at the exit end (41) in a substantially axial direction with respect to a central axis (31) of the engine.

9. The diffuser assembly (28) as defined in claim 7 wherein the inlet end section (46) of each of the diffuser pipes (38) comprises a connector (54) defining the inlet end (40) of the diffuser pipe (38) for connection with said one of the orifices (34) of the diffuser body (32).

10. The diffuser assembly (28) as defined in claim 7 wherein the depressed local area (58) in the pipe wall of the at least one diffuser pipe (38) is located downstream of the connector (54).

11. The diffuser assembly (28) as defined in claim 7 wherein the depressed local area (58) in the pipe wall of the at least one diffuser pipe (38) is located in the inlet end section (46), immediately upstream of the curved section (48).

12. The diffuser assembly (28) as defined in claim 7 wherein the depressed local area (58*a* or 58*b*) in the pipe wall of the at least one diffuser pipe (38) is located in the curved section (48).

13. The diffuser assembly (28) as defined in claim 7 wherein the at least one diffuser pipe (38) comprises a second depressed local area (58*c*) in the pipe wall of the inlet end section (46), circumferentially spaced apart from said depressed local area (58) with respect to a central axis (52) of the diffuser pipe (38).

14. The diffuser assembly (28) as defined in claim 13 wherein the second depressed local area (58*c*) located diametrically opposite to said depressed local area (58) with respect to a central axis (52) of the at least one diffuser pipe (38).

15. The diffuser assembly (28) as defined in claim 7 wherein the depressed local area (58) in the pipe wall of the at least one diffuser pipe (38) is in a location directly facing a portion of the diffuser body (32) which defines one (34*a*) of the orifices adjacent the orifice (34) connected to the at least one diffuser pipe (38), thereby providing an enlarged space (60) between the at least one diffuser pipe (38) and the diffuser body (32).

16. The diffuser assembly (28) as defined in claim 7 wherein the depressed local area (58) in the pipe wall of the at least one diffuser pipe (38) is in a location directly facing a portion of the adjacent diffuser pipe (38), thereby providing an enlarged space between the at least one diffuser pipe (38) and the adjacent diffuser pipe (38).

17. The diffuser assembly (28) as defined in claim 7 wherein each of the diffuser pipes (38) comprises the depressed local area (58) in the pipe wall of the inlet end section (46).

* * * * *